US005823242A

United States Patent [19]

Huang

[11] Patent Number: 5,823,242

[45] Date of Patent: Oct. 20, 1998

[54] SAFETY TASSEL FOR PULL CORDS

[75] Inventor: Chung-Chen Huang, Taipei, Taiwan

[73] Assignee: Teh Yor Industrial Co., Ltd., Taipei, Taiwan

[21] Appl. No.: 874,165

[22] Filed: Jun. 13, 1997

[51] Int. Cl.[6] ..... E06B 9/30

[52] U.S. Cl. ..... 160/178.1 R; 160/173; 16/122; 24/115 F; 24/128

[58] Field of Search ..... 160/178.1 R, 173 R; 24/128, 115 F, 129 R, 116 A; 16/122

[56] References Cited

U.S. PATENT DOCUMENTS

| | | | |
|---|---|---|---|
| 515,155 | 2/1894 | Nelson . | |
| 1,272,272 | 7/1918 | Kell . | |
| 2,164,206 | 6/1939 | Gits et al. | 16/122 |
| 3,974,589 | 8/1976 | Henze et al. | 24/115 F X |
| 3,988,810 | 11/1976 | Emery | 24/128 |
| 5,494,092 | 2/1996 | Georgopoulos | 24/115 F X |
| 5,504,977 | 4/1996 | Weppner et al. | 160/178.1 X |
| 5,518,057 | 5/1996 | Huang | 160/178.1 |
| 5,542,461 | 8/1996 | Huang | 160/178.1 |
| 5,542,462 | 8/1996 | Elsenheimer et al. | 160/178.1 R |
| 5,644,821 | 7/1997 | Zaguroli, Jr. | 24/115 F X |

*Primary Examiner*—Blair Johnson
*Attorney, Agent, or Firm*—Olson & Hierl, Ltd.

[57] ABSTRACT

A pull cord tassel that comprises a body defining first and second apertures for releasably holding a pull cord or a string is disclosed. The first aperture is integral with an elongated aperture which is in turn integral with an assembly aperture. The first string is located in the first aperture and can be moved through the elongated aperture into the assembly aperture where the string is released.

13 Claims, 3 Drawing Sheets

SAFETY TASSEL FOR PULL CORDS

This application claims the priority of the U.S. design patent application Ser. No. 29/069,186, entitled CORD PULL, filed by Chung-Chen Huang on Apr. 14, 1997.

FIELD OF THE INVENTION

The present invention relates generally to a safety tassel for pull cords used for window coverings including venetian blinds and the like.

BACKGROUND OF THE INVENTION

Window coverings such as venetian blinds typically use strings or cords for raising and lowering the covering. Usually, there are two or more strings hanging down from one side of the window covering. The strings or pull cords can be held together by either tying the strings together in a knot toward the end of the strings or by employing a separate device such as a tassel to grasp or couple the strings and hold them together. A disadvantage of coupling the strings together in this manner is the potential for injury to a child who becomes tangled in the strings.

Devices such as those disclosed in U.S. Pat. No. 4,635,698 to Anderson, U.S. Pat. No. 4,967,824 to Colson et al., and U.S. Pat. No. 5,058,650 to Morris, securely lock adjacent cords together but may not easily release the cords when a child becomes entangled in them. These devices typically are comprised of at least two pieces that lock together while clamping the cords between the pieces so that the plurality of cords can be operated as one. Also, locking devices of this type are mainly used to equalize the lengths of the cords so that the window cover is kept level as it is raised or lowered.

U.S. Pat. No. 4,782,560 to Keller discloses a tassel structure for joining the ends of strings such as pull cords used to operate a lamp. This tassel, however, is comprised of multiple parts and also lacks a safety release feature.

U.S. Pat. No. 4,909,298 to Langhart et al. and U.S. Pat. No. 4,473,797 to Wu disclose safety devices for retaining the pull cords of window coverings. The devices disclosed by Langhart et al. and Wu are two-piece structures that attach to the ends of pull cords and come apart upon the application of transverse forces when a child's neck or body part becomes entangled between the strings. While these devices release the child from the strings, they are relatively complex in that they are made of two pieces that must be re-assembled once they are pulled apart.

What is needed is a simple one-piece device that can hold two pull cords or strings together but can also accomplish the safety feature of releasing the pull cords when a child becomes entangled in them. The tassel should be relatively easy to manufacture and simple to use. The present invention meets these desires.

SUMMARY OF THE INVENTION

The present invention relates to a tassel for use with the pull cords of window coverings such as venetian blinds or the like. Typically, the pull cord tassel of the invention holds two strings or cords together when the tassel is at rest, and allows at least one of the strings to be released when a lateral force is applied to it such as in the event that a child becomes entangled between the strings.

The tassel comprises a body that defines a configuration of apertures which, through their unique shapes, releasably hold first and second strings in place and allow the release of at least one of these strings when a child becomes entangled between them. The first string has a first enlargement, such as a knot, near its end.

The body of the preferred embodiment defines a cavity, a first aperture for receiving the first string, an elongated aperture, and an assembly aperture. The first aperture is integral with the elongated aperture which is in turn integral with the assembly aperture. The first, elongated, and assembly apertures are all in communication with the cavity.

The first aperture and the elongated aperture are at least as large as the size of the first string and smaller than the first enlargement. The assembly aperture is larger than the first enlargement. The pull cord tassel is adapted to hold the first string with the first enlargement in the cavity when the first string is positioned through the first aperture. The tassel releases the first string when the first string is moved through the elongated aperture and into the assembly aperture, through which the first enlargement can pass.

Also, the body may include a second aperture which holds the second string. The second aperture is also in communication with the cavity, and the second string also has a second enlargement near its end which is held within the cavity of the body while the second string is located through the second aperture.

In this manner, the tassel, when at rest, hangs from the two strings with their respective enlargements located in the cavity, and the strings themselves are positioned through the apertures. The first and second apertures are at least as large as the size of the respective strings, but are smaller than the respective enlargements near the ends of the string. "As large as" includes apertures that create a small amount of compression on the strings, but still allow the string to move through relatively freely.

The elongated aperture is preferably no wider than the size of the first aperture. It is also acceptable for the elongated aperture to create a certain amount of compression on the string while allowing the string to pass through. The elongated aperture is substantially aligned with the first and second apertures so that a lateral force on the first string in the direction away from the second string will cause the first string to travel through the elongated aperture toward the assembly aperture. The distance between the first and second apertures is such that any object larger than that distance that becomes entangled between the strings will create a lateral force as described above.

In use, the first and second strings are preferably located through their respective apertures, with the respective enlargements located within the cavity of the body. The tassel is biased against the enlargements by the force of gravity. When a child's body part, such as the neck, becomes entangled between the strings, opposing lateral forces are applied to the strings. The lateral force on the first string causes it to move out of the first aperture and into and through the elongated aperture.

Once the first string moves through the elongated aperture it enters the assembly aperture. The assembly aperture is dimensioned to be larger than the enlargement on the end of the first string, thereby allowing the enlargement to pass through the aperture and as a result, the first string is released from the tassel.

Numerous other advantages and features of the present invention will become readily apparent to those skilled in the art from the following detailed description of the preferred embodiment of the invention, the drawings and the appended claims.

DETAILED DESCRIPTION OF THE PREFERRED EMBODIMENTS

Figure 1:
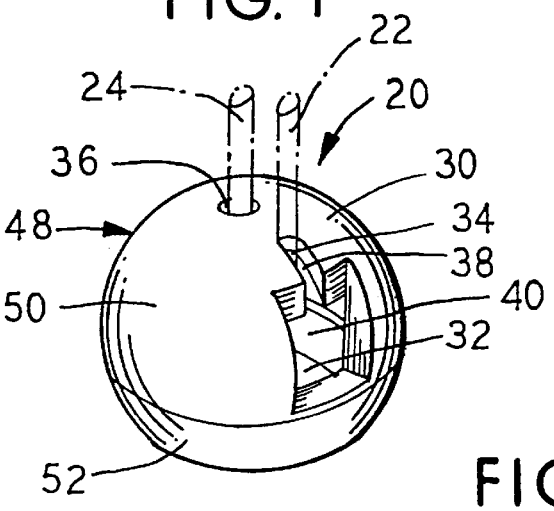
FIG. 1 is a perspective view showing a pull cord tassel of the present invention with first and second strings positioned within first and second apertures respectively.

While this invention can be embodied in many different forms, there are shown in the drawings and described in detail, preferred embodiments of the invention. The present disclosure is an exemplification of the principles of the invention and is not intended to limit the invention to the embodiments illustrated.

Referring to FIGS. 1 through 5 of the drawings, one embodiment of the present invention, a safety tassel 20 for pull cords or strings 22 and 24, is shown. The strings or cords on which the present invention is generally used are for raising and lowering window coverings such as venetian blinds and the like. The tassel 20 is a relatively simple and inexpensive device that couples the ends of a pair of strings and provides a grip that can be held when a user is pulling the strings to raise or lower the window covering. The tassel 20 also includes a safety feature that helps prevent injury to children who may become entangled in the strings. This safety feature is accomplished by the present invention, because the tassel 20 comprises a body 30 that defines a configuration of apertures that releasably hold the first string 22.

Figure 2:
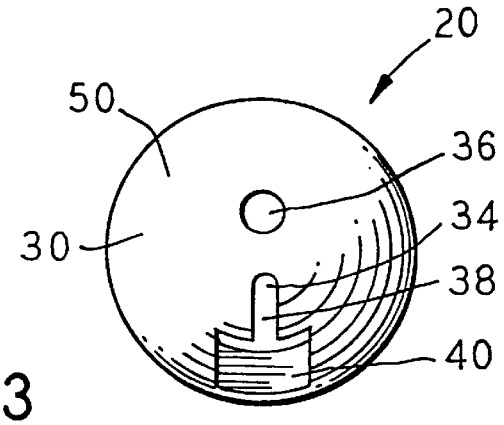
FIG. 2 is a top plan view of the pull cord tassel showing the first and second apertures, the elongated aperture, and the assembly aperture.
Figure 3:
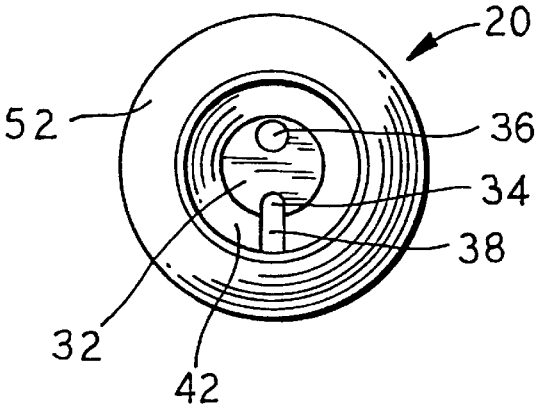
FIG. 3 is a bottom plan view showing a bottom opening and the cavity of the pull cord tassel.

In the preferred embodiment, the tassel 20 comprises a substantially spherical body 30 that defines a cavity 32, a first aperture 34, a second aperture 36, an elongated aperture 38, and an assembly aperture 40. As shown in FIGS. 1–3, the first aperture 34, elongated aperture 38, and assembly aperture 40 are all integral with each other and in communication with the cavity 32.

Figure 4:
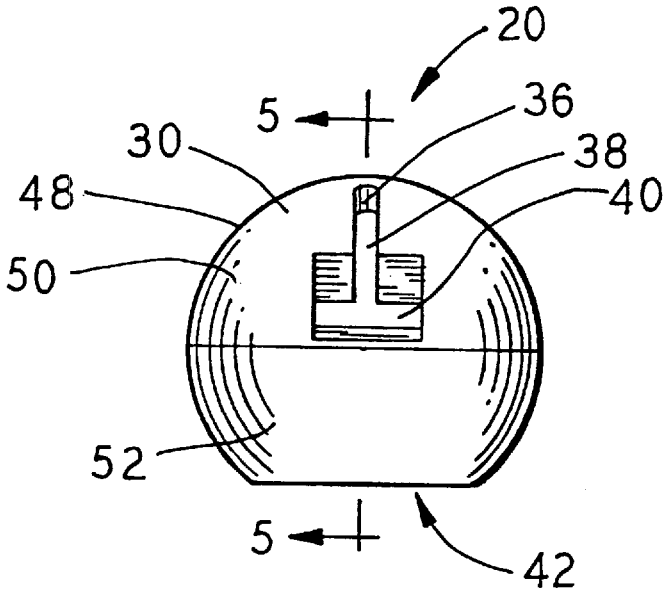
FIG. 4 is a front plan view showing the first, elongated, and assembly apertures.

Preferably, the first aperture 34 is substantially round, and the assembly aperture 40 is substantially quadrangular as shown in FIGS. 2 and 4, respectively. Also, the second aperture 36 preferably is round. Alternatively, the apertures of the invention may be defined in a variety of shapes.

The body 30 includes a top surface 48 and can be divided into a top hemisphere 50 and a bottom hemisphere 52. The body 30 also has a vertical axis. The first and second apertures, 34 and 36, have axes that are preferably substantially parallel to the vertical axis of the body 30 and are laterally juxtaposed in relation to the axis of the body 30. The elongated aperture 38 has a longitudinal axis that follows the curvature of the top surface 40 and is substantially aligned with the axes of the first and second apertures, 34 and 36, so as to substantially define a plane.

Referring again to FIG. 2, the first aperture 34 is located at or near the uppermost portion of the top hemisphere 50 of the body 30, and the elongated aperture 38 extends downwardly from the first aperture 34 along the spherical body 30 until it terminates at the assembly aperture 40. In the preferred embodiment, the first aperture 34, second aperture 36, elongated aperture 38, and assembly aperture 40 are all located substantially on the top hemisphere 50.

Figure 5:
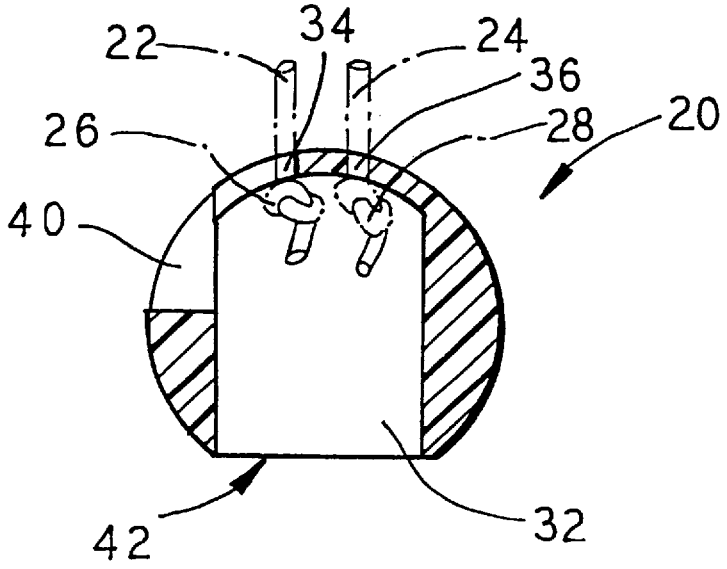
FIG. 5 is a sectional view of the pull cord tassel taken along plane 5—5 of FIG. 4.

In normal operation, the first string 22 is located through the first aperture 34, and the first aperture 34 preferably is about or at least as large as the size of the first string 22. The elongated aperture 38 is preferably no wider than the first aperture 34, but may be narrower. The elongated aperture 38 is wide enough to allow the first string 22 to pass laterally through it with relatively little or no resistance. The first and second strings 22 and 24 have first and second enlargements 26 and 28 on their respective ends as shown in FIG. 5. While the first and elongated apertures, 34 and 38, are preferably about the size of the first string 22, they are smaller than the size of the first enlargement 26. The assembly aperture 40, however, is larger than the first enlargement 26 so that the first enlargement 26 can easily pass through it. The tassel 20 thereby releases the first string 22 when the first enlargement 26 passes through the assembly aperture 40.

Referring again to FIG. 5, the second aperture 36 is also about or at least as large as the size of the second string 24 but smaller than the second enlargement 28. The second string 24 is located through the second aperture 36 in a manner similar to that of the first string 22 and first aperture 34. In the preferred embodiment, the first and second enlargements, 26 and 28, are simply knots tied near the ends of the strings 22 and 24 and located within the cavity 32. Alternatively, the enlargements could be comprised of separate pieces attached to the strings or any other configuration that serves to hold the strings within their respective apertures when the body 30 is hanging from the strings 22 and 24.

The cavity 32, shown in FIG. 3, is preferably in communication with a bottom opening 42 which is located at the bottom hemisphere 52 of the body 30 substantially opposite the first and second apertures, 34 and 36. The bottom opening 42 is substantially centered on the vertical axis of the body 30. The bottom opening 42 is substantially round and provides access to the cavity 32 of the body 30. Also, the bottom opening 42 allows foreign objects or debris be removed or to fall out of the body 30 when the tassel 20 is in use. This is desirable, because the foreign objects can interfere with the enlargements 26 and 28 of the strings 22 and 24 and impede the proper function of the tassel 20. For example, a foreign object may become lodged within the cavity 32 and prevent the first string 22 from being released by the tassel 20.

In the preferred embodiment, the body 30 is biased against the enlargements, 26 and 28, by gravity. The tassel 20 thus hangs from the strings 22 and 24 in normal use. Also, when the tassel 20 is grasped by a user who is raising or lowering the window covering, the body 30 is biased against the enlargements 26 and 28 by the downward force exerted by the user.

When the first and second strings, 22 and 24, are within their respective apertures, 34 and 36, the force of gravity biases the body 30 against the enlargements, 26 and 28, causing the tassel 20 to hang from the strings 22 and 24. When a child becomes entangled in the strings, the placement of a body part between the strings causes a substantially lateral force to be applied to the strings, 22 and 24, which causes them to move away from each other. Since the elongated aperture 38 is substantially aligned in the same plane with the first and second apertures, 34 and 36, the lateral force causes the first string 22 to move away from the second string 24 in the direction of the elongated aperture 38. During the application of the lateral force, the first string 22 then exits the first aperture 34, enters the elongated aperture 38, and moves through the elongated aperture 38 toward the assembly aperture 40.

The opposing lateral force on the second string 24 causes additional biasing of the second enlargement 28 against the body 30. The additional biasing force pulls the body 30 in the direction opposite that in which the first string 22 is moving.

The first string 22 moves through the elongated aperture 38 until it reaches the assembly aperture 40. Upon entering the assembly aperture 40, the first string 22 is released from the tassel 20, because the first enlargement 26 can pass through the assembly aperture 40. The second string 24 remains within the second aperture 36.

To reassemble the tassel 20 and strings, 22 and 24, the user can simply reinsert the first enlargement into the cavity 32 of the body 30 through the assembly aperture 40 and guide the first string 22 back through the elongated aperture 38 toward the first aperture 34.

Figure 6:
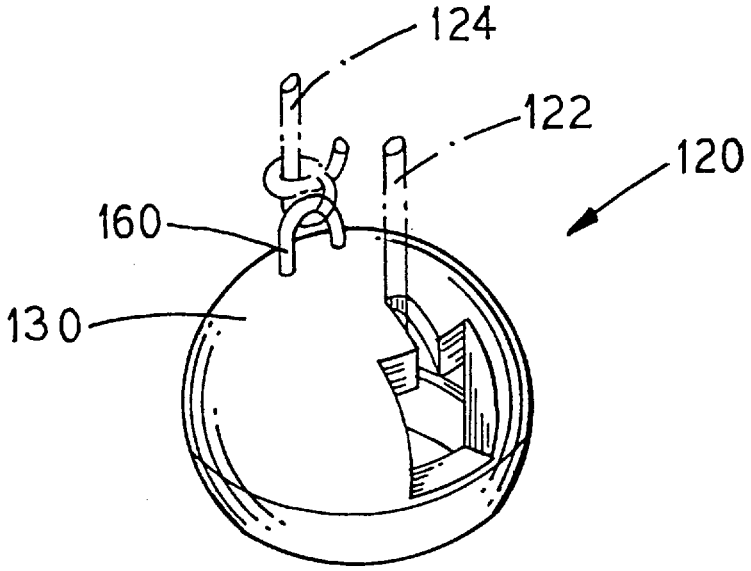
FIG. 6 is a perspective view of an alternate embodiment of the safety tassel of the present invention showing a protrusion for holding the second string.

An alternate embodiment of the tassel 120 of the invention is illustrated in FIG. 6 which shows an alternate means for the holding of a second string 124 by the body 130. A protrusion such as a loop 160 can be provided to which the second string 124 can be attached. Other alternate attachment or holding means may be provided. For example, the second string 24 can be attached to the body with an adhesive or a fastener.

Yet another alternative for holding the second string may comprise an aperture configuration that is the mirror image of the configuration that includes the first aperture 34, the elongated aperture 38, and the assembly aperture 40.

The tassel 20 is preferably made of injection molded plastic, but may alternatively be made of any suitable material that is relatively durable. Other materials known in the art may be formed or machined into the configurations claimed or described herein.

Although the invention has been described with reference to certain embodiments, numerous modifications and variations can be made by those skilled in the art without departing from the novel spirit and scope of this invention.

What is claimed is:

1. A pull cord tassel for releasably holding a first string and for holding a second string, the first string having a first enlargement near its end, the pull cord tassel comprising:

a hollow, generally spherical body having a top hemisphere and a bottom hemisphere and defining a cavity, a first aperture for receiving the first string, an elongated aperture, and an assembly aperture; the first aperture being integral with the elongated aperture which is in turn integral with the assembly aperture; and the first, elongated, and assembly apertures being in communication with the cavity. surrounded on all sides by the body, and located substantially on the top hemisphere;

the first aperture and the elongated aperture being at least as large as the size of the first string and smaller than the first enlargement, the assembly aperture being larger than the first enlargement, the pull cord tassel being adapted to hold the first string with the first enlargement in the cavity when the first string is positioned through the first aperture and to release the first string when the first string is moved through the elongated aperture and into the assembly aperture through which the first enlargement can pass.

2. The pull cord tassel of claim 1 wherein the body further defines a second aperture in communication with the cavity for holding a second string, the second string having a second enlargement near its end, the second aperture being at least as large as the size of the second string and smaller than the enlargement, and the second string being positioned through the second aperture.

3. The pull cord tassel of claim 1 further comprising means for holding the second string.

4. The pull cord tassel of claim 3 wherein the means for holding the second string comprises a protrusion from the body to which the second string is attached.

5. The pull cord tassel of claim 4 wherein the protrusion comprises a loop.

6. The pull cord tassel of claim 1 wherein the body further defines a bottom opening on the bottom hemisphere substantially opposite the first aperture and in communication with the cavity.

7. The pull cord tassel of claim 2 wherein the body includes a top surface and has a vertical axis, the first and second apertures each having an axis, and the first and second apertures being positioned on the body such that their axes are substantially-parallel to the vertical axis of the body.

8. The pull cord tassel of claim 7 wherein the elongated aperture has a longitudinal axis and the axes of the first, second, and elongated apertures substantially define a plane.

9. The pull cord tassel of claim 8 wherein the bottom hemisphere defines a bottom opening for access to the cavity and so that foreign bodies within the cavity can drop out of the cavity when the first and second strings are within the respective apertures and the tassel is hanging from the strings.

10. The pull cord tassel of claim 9 wherein the first and second apertures are juxtaposed on the top hemisphere, and the body is biased against the enlargements by gravity when the first and second strings are within the respective apertures, causing the tassel to hang from the strings; and wherein the elongated aperture is aligned with the first and second apertures so that a substantially lateral force applied to the first string causes the first string to exit the first aperture and travel through the elongated aperture and into the assembly aperture where the enlargement on the first string can pass through the assembly aperture thereby releasing the first string.

11. A pull cord tassel for releasably holding a first string and for holding a second string, the first and second strings having first and second enlargements, respectively, near their ends, the pull cord tassel comprising:

a body defining a cavity, a first aperture for receiving the first string, a second aperture for receiving the second string, an elongated aperture, and an assembly aperture and having a top hemisphere and a bottom hemisphere; the first aperture being integral with the elongated aperture which is in turn integral with the assembly aperture; the first, second, elongated, and assembly apertures being in communication with the cavity, surrounded on all sides by the body and located substantially on the top hemisphere; the first and second apertures being at least as large as the first and second strings, respectively, and smaller than the first and second enlargements, respectively; the elongated aperture being no wider than the size of the first aperture; the assembly aperture being larger than the first enlargement;

the first and second apertures being juxtaposed on the top hemisphere so that when the first and second strings are within the respective apertures, the respective enlargements on each string are within the cavity and are biased against the body by gravity, causing the tassel to hang from the strings; and the elongated aperture is aligned with the first and second apertures so that a substantially lateral force applied to the first string causes the first string to exit the first aperture and travel through the elongated aperture and into the assembly aperture where the enlargement on the first string can pass through the assembly aperture thereby releasing the first string.

12. The pull cord tassel of claim 11 wherein the body further defines a bottom opening on the bottom hemisphere substantially opposite the first aperture.

13. The pull cord tassel of claim 1 wherein the first aperture is adapted to hold the first string and the second string.

* * * * *